United States Patent [19]

Skaggs

[11] Patent Number: 4,911,265

[45] Date of Patent: Mar. 27, 1990

[54] LADDER PLATFORM WITH RUNG SECURING MECHANISM

[76] Inventor: Jerry W. Skaggs, P.O. Box 1031, Charleston, W. Va. 25234

[21] Appl. No.: 316,880

[22] Filed: Feb. 28, 1989

[51] Int. Cl.[4] ..... E06C 7/16

[52] U.S. Cl. ..... 182/121; 248/238

[58] Field of Search ..... 182/121, 120, 122; 248/310, 238

[56] References Cited

U.S. PATENT DOCUMENTS

| | | | |
|---|---|---|---|
| 407,079 | 7/1889 | Laskey | 182/121 |
| 1,187,437 | 6/1916 | Lucas | 182/121 |
| 3,309,053 | 3/1967 | Baker | 182/122 |
| 3,899,045 | 8/1975 | Geisel | 182/121 |
| 4,687,075 | 8/1987 | Skaggs | 182/121 |

FOREIGN PATENT DOCUMENTS

| | | | |
|---|---|---|---|
| 2036152 | 6/1980 | United Kingdom | 182/121 |

*Primary Examiner*—Reinaldo P. Machado

*Attorney, Agent, or Firm*—Berman, Aisenberg & Platt

[57] ABSTRACT

A safety platform for a ladder comprises a foot platform which engages a lower rung of the ladder and brackets for being secured to an upper rung of the ladder to support the platform. A locking means is provided on the foot platform for securely engaging a lower rung of the ladder to prevent movement of the foot platform. Arcuate elements which engage an upper rung of the ladder are provided with set screws for clamping them to the upper rung also to provide stability for the foot platform.

9 Claims, 2 Drawing Sheets

LADDER PLATFORM WITH RUNG SECURING MECHANISM

TECHNICAL FIELD

This invention relates to an attachment for a ladder. The attachment includes a platform and means for attaching the platform to the rungs of a ladder.

BACKGROUND OF THE INVENTION

In my prior U.S. Pat. No. 4,687,075, I described a safety platform for a ladder which included a foot platform for engaging a lower rung and safety brackets for engaging an upper rung for securing the foot platform The safety brackets included a locking arm which held arcuate elements of the safety brackets loosely looped over an upper rung. The foot platform included a stop which engaged only one side of the lower rung on which the platform rested.

While my prior structure has proven to be extremely useful, a tendency for the foot platform to move rearwardly, away from the stop, has been observed.

SUMMARY OF THE INVENTION

In accordance with my invention, I provide an improved safety platform for a ladder which includes mechanisms for securing the foot platform to the rungs of a ladder such that it is stable and moves neither rearwardly o forwardly.

A first mechanism for securing the foot platform to the rung of the ladder comprises a locking element having a recess therein for engaging a front side of a rung on which the foot platform rests. The locking element is pivotally mounted to the foot platform at a location longitudinally aligned with the stop means used in my earlier device and spaced rearwardly from that stop. Because it is pivotally mounted, the front, recessed edge of the locking element engages the front side of the rung to automatically adjust the distance between the element and the stop and to wedge the rung between them. This allows automatic adjustment to the width of the ladder's rung and permits easy installation. The element has a protruding portion at its top which engages the rung of the ladder causing the element to pivot upwardly such that a recessed portion of the front edge of the element then engages the rear portion of the rung. A slot is provided in the foot platform for receiving this protrusion when the bottom surface of the foot platform rests directly on the top surface of the rung.

A second mechanism for securing the platform to the ladder comprises an arcuate member which extends from a front of an upper rung over the top of that rung and over the rear of the rung. A set screw extends through the portion on the rear side of rung to clamp the rung to the arcuate support.

An object of this invention is to provide an improved platform for a ladder having means for securing the platform to the ladder.

Another object of this invention is to provide an improvement for a safety platform for a ladder wherein means are provided for securely engaging the rung of the ladder on which the platform rests.

Yet another object of this invention is to provide an improved safety platform for a ladder having means for securely engaging a rung of the ladder above the rung on which the foot platform rests.

DETAILED DESCRIPTION OF THE INVENTION

Figure 1:
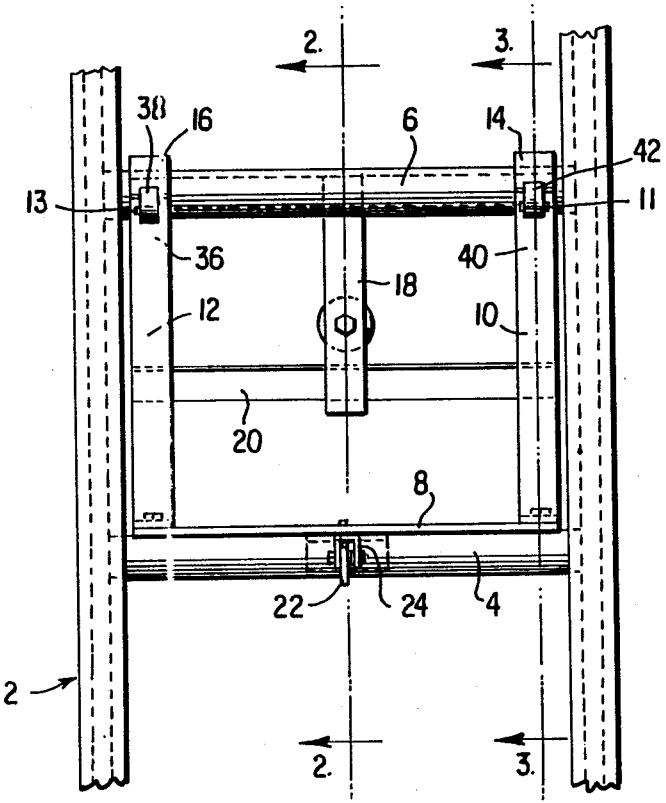
FIG. 1 is a front view of a safety platform in accordance with the invention.
Figure 4:
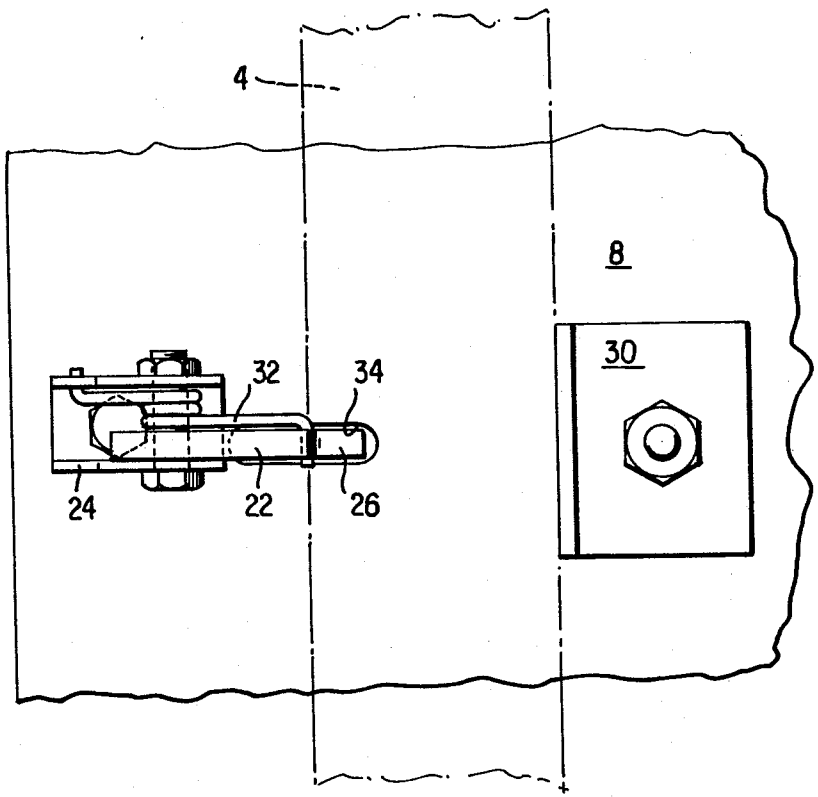
FIG. 4 is a partial bottom view of the foot platform.

With reference to FIG. 1, a ladder 2 comprises a lower rung 4 and an upper rung 6. A foot platform 8 is shown resting on the lower rung 4. Brackets 10 and 12 extend from a rear portion of the foot platform 8 upwardly at a generally acute angle with respect to the foot platform to a location adjacent a front side of the upper rung 6. Arcuate elements 14 and 16 are attached to brackets 10 and 12, respectively, by hinges and extend over the top of upper rung 6 and to a rear side thereof. A locking bar 18 engages a cross brace 20 to hold arcuate elements 14 and 16 looped over upper rung 6.

Figure 2:
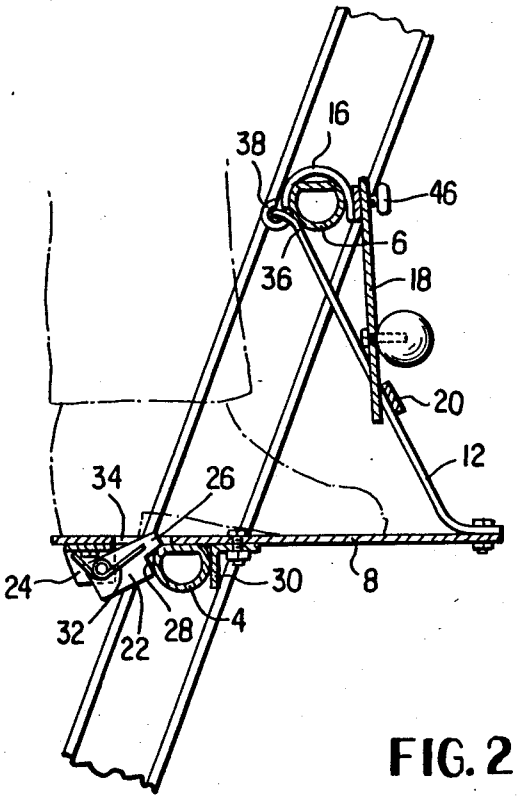
FIG. 2 is a cross section taken along line 2—2 of FIG. 1.

A locking element 22 is pivotally mounted by bracket 24 to foot platform 8. Locking element 22 engages the front of lower rung 4 in a manner to be described more fully below. With reference to FIG. 2, parking element 22 includes a protrusion 26 and a recessed edge 28. A stop 30 is fixed to foot platform 8 to engage a rear side of lower rung 4, while locking element 22 is arranged to engage the front side of lower rung 4. The cooperation between locking element 22 and stop 30 secures platform 8 against either forward or rearward sliding motion on lower rung 4.

Locking element 22 is biased by spring 32 to urge protrusion 26 away from platform 8. As the platform is lowered onto rung 4 during installation, protrusion 26 engages an upper portion of lower rung 4, causing locking element 22 to pivot such that the rung is wedged between recessed edge 28 and stop 30. A slot 34 is provided and foot platform 8 to receive protrusion 26 when foot platform 8 is resting on top of lower rung 4.

The operation of locking bar 18 has been described in my earlier-mentioned U.S. patent, and the only difference between its operation there and in the present improvement is that the spring action referred to in my earlier patent is not necessary for proper operation of my improved platform.

Figure 3:
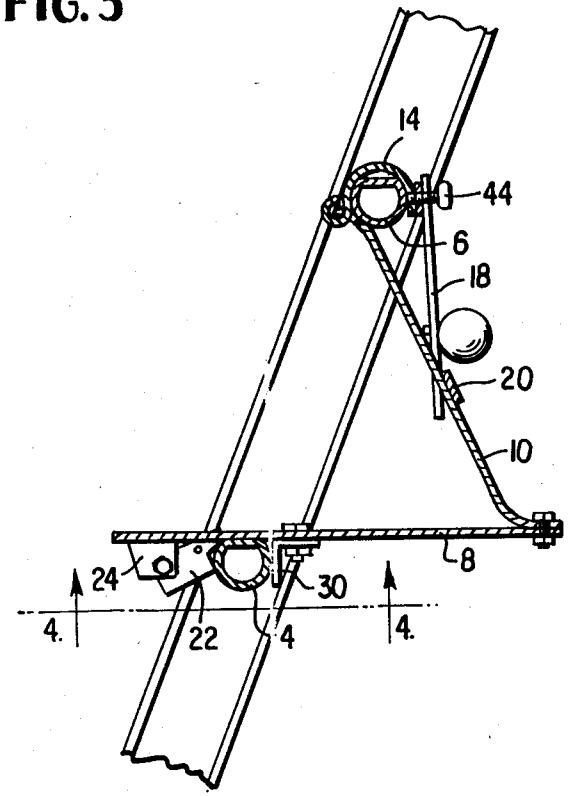
FIG. 3 is a cross section taken along line 3—3 of FIG. 1.

A second mechanism for securing platform 8 to the ladder is shown in FIGS. 2 and 3 and comprises an arrangement for the arcuate elements 14 and 16 which allows them to be clamped to upper rung 6. Brackets 10 and 12 terminate in ends 36 and 40 which have holes 11 and 13 therein. Arcuate element 16 includes a tab 38 which passes through hole 13 to provide a simple, but rugged hinge for allowing arcuate element 14 to be placed over upper rung 6. Arcuate element 14 includes a tab 42, identical to tab 38, which passes through hole 11.

Arcuate elements 14 and 16 include set screws 44 (FIG. 3) and 46 (FIG. 2). These set screws are placed on a portion of the arcuate members 14 and 16 which is located adjacent the rear side of upper rung 6 when the foot platform 8 is installed. As illustrated in FIGS. 2 and 3, each of the arcuate elements 14 and 16 has an angular extent such that it extends from a front side of upper rung 6, over the top of the rung, and to the rear of the rung. Set screws 44 and 46 clamp the upper rung 6 between the front and rear portions of the arcuate elements to secure those elements to the rung.

This securing of the arcuate elements to the upper rung provides stability to the foot platform 8 such that it is possible to dispense with locking element 22, if so desired. Thus, foot platform 8 having locking element 22 and set screws 44 and 46 would be extremely stable, but provision of either of these elements alone is within the contemplation of the invention.

It will be appreciated that, while brackets 10 and 12, stop 30 and bracket 24 are shown bolted to foot platform 8, other methods of attachment may be employed. Similarly, the pivot connection between locking element 22 and bracket 24 is preferably a bolt, but other pivot mechanisms may be used.

Modifications of the invention within the scope of the appended claims will apparent to those of skill in the art.

I claim:

1. An attachment for use with a ladder comprising a platform having a bottom part for engaging an upper surface of a rung of said ladder and an upper part for receiving the feet of a user, a first stop attached to said platform for engaging one side of said rung, and a second stop attached to said platform for engaging an opposite side of said rung, wherein at least one of said first and second stops comprises adjustable means for automatically adjusting the distance between said first and second stops to that of the width of said rung for providing a secure engagement between said first and second stops and said rung.

2. An attachment according to claim 1 wherein said first stop means is fixed with respect to said platform, and said second stop means comprises said adjustable means, wherein said adjustable means comprises an element pivotally attached to said plate, said element having an edge for engaging said opposite side of said rung.

3. An attachment according to claim 2 wherein said edge comprises a protruding part for engaging the top of said rung and a recessed portion for engaging said opposite side of said rung.

4. An attachment according to claim 3 wherein said edge of said element is spring biased in a direction away from said platform.

5. An attachment according to claim 3 wherein said platform has a slot therein for receiving said protruding part when said recessed part engages said opposite side of said rung.

6. An attachment according to claim 5 wherein said element is rigid.

7. An attachment according to claim 6 further comprising means for attaching said platform to a second part of said ladder.

8. An attachment according to claim 7 wherein said second part comprises a second rung.

9. An attachment according to claim 8 wherein said means for attaching said platform to a second rung comprises bracket means attached to a rear portion of said platform and extending to a second end for being positioned adjacent a front of said second rung and arcuate means for extending over the top of said second rung at least to the rear of said second rung, wherein said arcuate means comprises set screw means extending from said rear of said rung toward said front of said rung for engaging said rear of said rung and clamping said arcuate means to said second rung for stabilizing said platform.

* * * * *